US008414221B2

(12) United States Patent
Faucher et al.

(10) Patent No.: US 8,414,221 B2
(45) Date of Patent: Apr. 9, 2013

(54) TAMPER DEVICE

(75) Inventors: Thomas R. Faucher, Manchester, NH (US); John D. Lefavour, Litchfield, NH (US); Mark A. Chiasson, Merrimack, NH (US)

(73) Assignee: Hubbell Incorporated, Shelton, CT (US)

( * ) Notice: Subject to any disclaimer, the term of this patent is extended or adjusted under 35 U.S.C. 154(b) by 171 days.

(21) Appl. No.: 12/928,136

(22) Filed: Dec. 2, 2010

(65) Prior Publication Data

US 2011/0135389 A1 Jun. 9, 2011

Related U.S. Application Data

(60) Provisional application No. 61/283,555, filed on Dec. 4, 2009.

(51) Int. Cl.
*E01C 19/30* (2006.01)

(52) U.S. Cl.
USPC ..... 404/133.05

(58) Field of Classification Search ..... 404/133.05, 404/133.1, 133.2
See application file for complete search history.

(56) References Cited

U.S. PATENT DOCUMENTS

| | | | | |
|---|---|---|---|---|
| 2,917,979 | A | 12/1959 | Dening et al. | |
| 3,259,035 | A | 7/1966 | Pfundt | |
| 3,534,669 | A | 10/1970 | Judd | 94/49 |
| 3,603,224 | A | 9/1971 | Dresher | 94/48 |
| 3,673,931 | A | 7/1972 | Dening et al. | 94/45 A |
| 3,961,856 | A * | 6/1976 | Degenhart | 404/133.05 |
| 4,156,576 | A * | 5/1979 | Clavel et al. | 404/133.2 |
| 4,493,585 | A * | 1/1985 | Axer | 404/102 |
| 4,828,428 | A * | 5/1989 | Anderson | 404/102 |
| 5,129,803 | A * | 7/1992 | Nomura et al. | 425/62 |
| 5,236,279 | A | 8/1993 | Grinager | 404/133.05 |
| 5,340,233 | A | 8/1994 | Motl | 404/133.05 |
| 6,551,018 | B2 | 4/2003 | Baker et al. | 404/102 |
| 7,316,524 | B1 * | 1/2008 | Pikuet | 404/133.1 |
| 7,682,102 | B1 * | 3/2010 | Burke et al. | 404/133.1 |

* cited by examiner

*Primary Examiner* — Gary S Hartmann
(74) *Attorney, Agent, or Firm* — Harrington & Smith

(57) ABSTRACT

Disclosed herein is a tamper device. The tamper device includes a housing, a drive, a tamper, and a wobble connection. The drive is connected the housing. The tamper is adapted to reciprocate relative to the housing and apply pressure to a surface. The wobble connection is between the drive and the tamper, wherein the wobble connection includes a wobble plate. A first end portion of the tamper is at a side of the wobble plate.

13 Claims, 5 Drawing Sheets

TAMPER DEVICE

CROSS REFERENCE TO RELATED APPLICATION

This application claims priority under 35 U.S.C. §119(e) to U.S. provisional patent application No. 61/283,555 filed Dec. 4, 2009 which is hereby incorporated by reference in its entirety.

BACKGROUND

1. Field of the Invention

The invention relates to pole tamp drive mechanisms and, more particularly, to hydraulically operated pole tamp devices.

2. Brief Description of Prior Developments

Tamper/compactor devices are known in the art. For example, U.S. Pat. No. 3,259,035 discloses a hydraulically operated tamper, configured for manual movement, having a gear link assembly for providing a downward tamping thrust to a tamping head. U.S. Pat. No. 5,236,279 discloses a self-propelled concrete tamping apparatus. The tamping apparatus comprises a motor driven shaft connected to control arms to cause a tamper screen to reciprocate in a vertical direction. U.S. Pat. No. 5,340,233 discloses a pneumatically operated rammer comprising a centrifugal clutch connected to a percussion unit. The percussion unit provides a reciprocating vibrating motion to a shoe for compacting soil. U.S. Pat. No. 6,551,018 discloses an apparatus for tamping paving material. The apparatus includes a camshaft connected to a push rod configured to drive a tamper bar downward toward a paving material.

However, despite the above mentioned tamper/compacter devices, there is still a need in the art for an improved tamper device which provides a reliable and robust configuration.

SUMMARY

The foregoing and other problems are overcome, and other advantages are realized, by the use of the exemplary embodiments of this invention.

In accordance with one aspect of the invention, a tamper device is disclosed. The tamper device includes a housing, a drive, a tamper, and a wobble connection. The drive is connected the housing. The tamper is adapted to reciprocate relative to the housing and apply pressure to a surface. The wobble connection is between the drive and the tamper, wherein the wobble connection includes a wobble plate. A first end portion of the tamper is at a side of the wobble plate.

In accordance with another aspect of the invention, a tamper device is disclosed. The tamper device includes a housing, a rotatable shaft, a caming member, a connecting rod, and a tamper. The rotatable shaft has a first end and a second end. The first end is adapted to be connected to a drive. The second end extends into the housing. The caming member is connected to the rotatable shaft. The connecting rod has a first end portion and a second end portion. The first end portion includes an opening. The caming member is located at the opening. The first end portion is between and spaced from the first end and the second end of the rotatable shaft. The tamper is connected to the second end portion of the connecting rod.

In accordance with another aspect of the invention, a method of manufacturing a tamper device is disclosed. A housing is provided. A drive is connected to the housing. A tamper is movably connected to the housing. The tamper is adapted to apply pressure to a surface. A wobble connection is connected between the drive and the tamper. The wobble connection includes a wobble plate. The wobble plate is adapted to apply a reciprocating force to the tamper.

In accordance with another aspect of the invention, a method of manufacturing a tamper device is disclosed. A drive having an output shaft is provided. A housing is connected to the drive. At least a portion of the output shaft extends into the housing. A caming member is attached to the output shaft. A connecting rod is provided. A first end portion of the connecting rod extends into the housing. The first end portion includes an opening. A second end portion of the connecting rod extends out of the housing. The caming member is movably connected to the first end portion. The cam is at the opening. The output shaft is spaced from the opening. The output shaft extends through the opening. A tamper is connected to the second end portion of the connecting rod.

BRIEF DESCRIPTION OF THE DRAWINGS

The foregoing aspects and other features of the invention are explained in the following description, taken in connection with the accompanying drawings, wherein.

DETAILED DESCRIPTION

Figure 1:
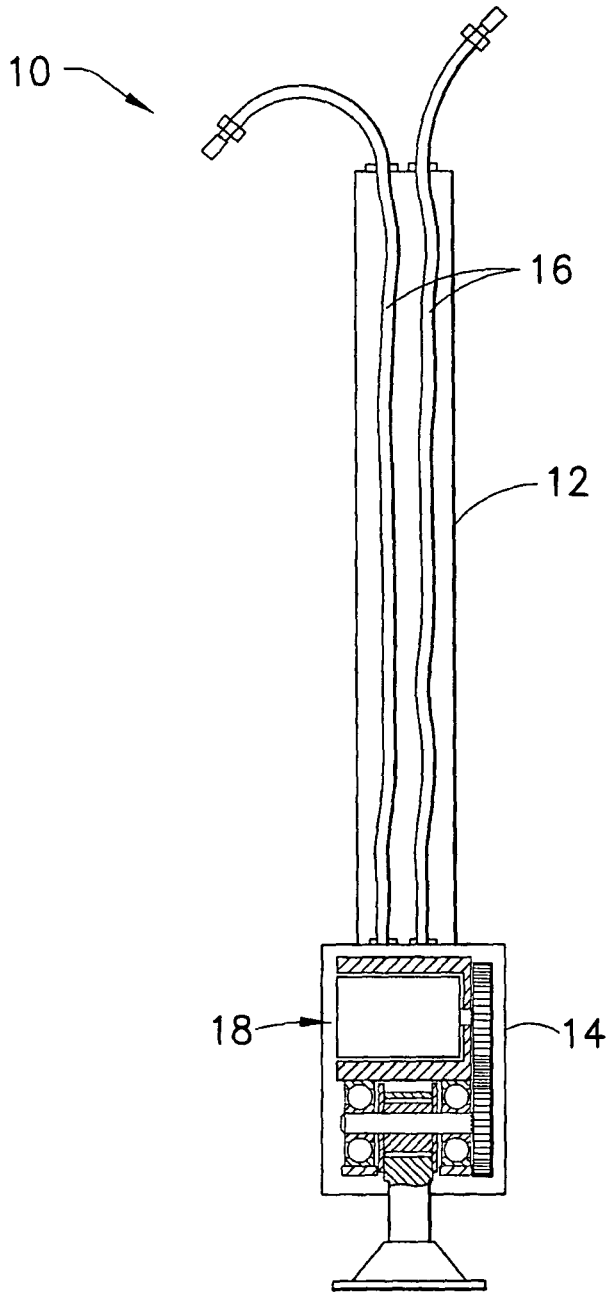
FIG. 1 is a section view of a tamper device incorporating features of the invention.

Referring to FIG. 1, there is shown a partial section view of a tamper device (or hydraulic pole tamp) 10 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

FIG. 1 shows a general assembly view of the hydraulic tamper device 10. The tamper device 10 comprises an upper frame section 12 and a lower frame section 14. The upper frame section 12 may comprise hydraulic lines 16. The lower frame section 14 comprises a drive assembly 18. According to this embodiment, the drive assembly 18 may comprise a gear driven assembly.

While the tamper device 10 has been described in connection with two frame sections, one skilled in the art will appreciate that embodiments of the invention are not necessarily so limited and that any suitable number of frame sections may be provided. For example, according to one embodiment, the tamper may comprise only a single frame section. According to another embodiment, the tamper may comprise three or more frame sections.

Figure 2:
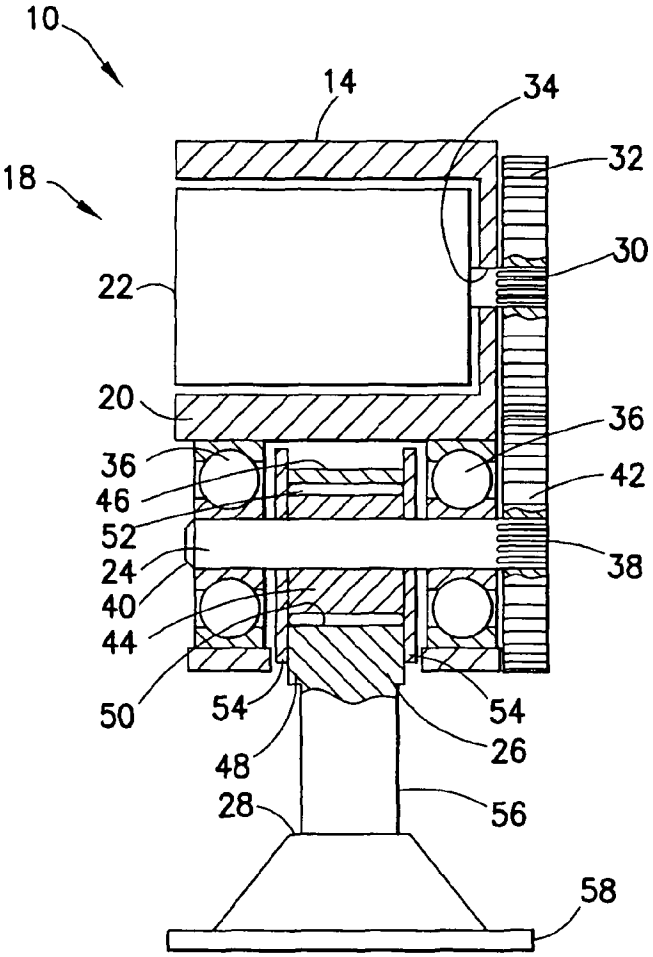
FIG. 2 is an enlarged section view of a drive assembly used in the tamper device shown in FIG. 1.

Referring now also to FIG. 2, an enlarged view of the gear driven assembly 18 is shown. The gear driven assembly 18 comprises a housing 20, a hydraulic motor 22, a shaft 24, a transfer case 26, and a tamper 28.

The housing 20 is suitably sized and shaped to contain various of the assembly elements therein. The housing 20 may comprise any suitable configuration or material.

The hydraulic motor (or drive) 22 comprises an output shaft 30 and a gear 32. The output shaft 30 extends from an end of the motor 22. The gear 32 is fixedly connected to the shaft 30. The motor 22 may be mounted to the housing 20 such that the output shaft 30 extends through an opening 34 in the housing 20. The motor 22 may be connected to the hydraulic lines 16 in any suitable fashion.

The shaft 24 is movably mounted to the housing 20 with a pair of bearings 36 therebetween. The bearings 36 may be connected to the housing 20 in any suitable fashion. The bearings 36 provide support to the shaft 24 proximate opposite ends 38, 40 of the shaft 24. The shaft 24 comprises a gear 42 fixedly connected to the shaft 24. The gear 42 is in mesh with the gear 32. The shaft 24 further comprises a caming member 44, such as an eccentric cam, for example. The shaft 24 may be keyed to the eccentric cam 44 proximate a center portion of the shaft 24. However, the cam 44 may be connected to the shaft 24 in any suitable fashion. The eccentric cam 44 may comprise a general circular shape with a center of rotation of the cam 44 off center from a centerpoint of the general circular shape. However, any suitably shaped cam or caming member may be provided.

Figure 3:
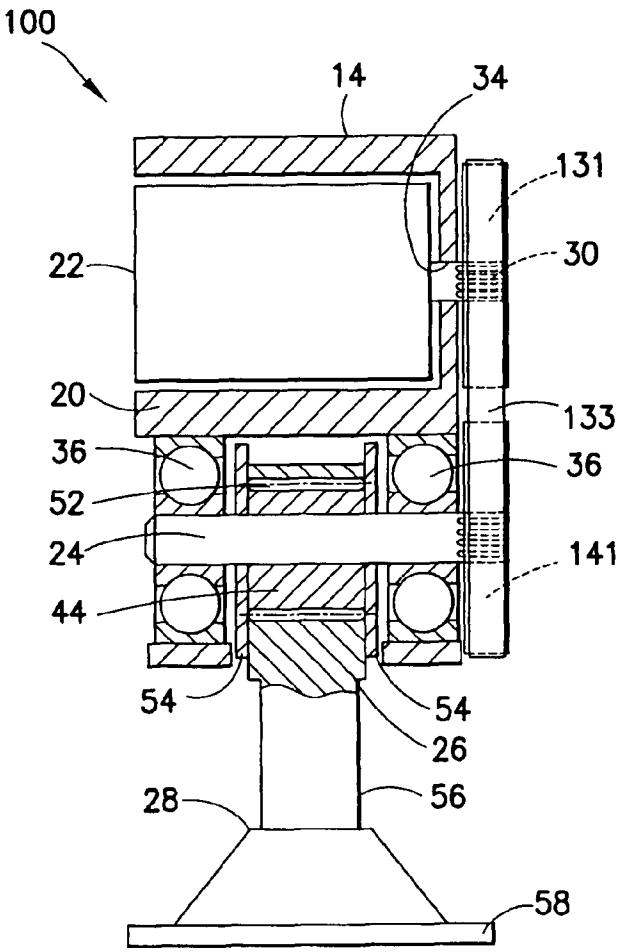
FIG. 3 is an enlarged section view of another embodiment of a drive assembly incorporating features of the invention.

It should be noted that although the tamper device 10 has been described above with the gears 32, 42 between the shafts 30, 24, any other suitable method of transferring rotational motion between the shafts may be provided. For example, as shown in FIG. 3, a tamper device 100 is shown. The tamper device 100 is similar to the tamper device 10 and similar features are similarly numbered. The tamper device 100 may comprise a belt 133 between the output shaft 30 and the shaft 24. The belt 133 may be connected to pulleys 131, 141 mounted on the shafts 30, 24. However, any suitable configuration may be provided.

The transfer case 26 comprises a first end 46 and an opposite second end 48. The first end 46 comprises an opening 50. The opening 50 surrounds the center portion of the shaft 24 and holds the caming member 44. A needle bearing 52 may additionally be provided between the transfer case 26 and the caming member 44 at the opening 50. As the shaft 24 and caming member 44 rotate, an outer surface of the caming member contacts the opening 50 of the transfer case 26 and/or the needle bearing 52 to convert the rotational motion of the shaft 24 to a reciprocal motion of the tamper 28. With the opening 50 extending through the first end 46 of the transfer case 26, a pair of washers 54 may be provided on each side of the opening 50, between the bearings 36 and the caming member 44. The washers 54 may be any suitable type washers, such as Delrin® washers for example. The second end 48 of the transfer case 26 is adapted to be connected to the tamper 28.

The tamper 28 comprises a ram portion 56 and a shoe portion 58. The ram portion 56 is connected to the second end 48 of the transfer case 26. Any suitable type connection between the ram portion 56 and the second end of the transfer case 26 may be provided. The shoe portion 58 is opposite the ram portion 56. The shoe portion 58 is suitably sized and shaped to apply pressure to a surface, such as soil for example.

As the hydraulic motor 22 runs, the output shaft 30 rotates the gear 32 (or the belt 133) to rotate the shaft 24 that is keyed to the eccentric cam 44. The cam 44, held in the transfer case 26 drives the ram portion 56 and the shoe portion 58 in the up and down motion (towards the shaft and away from the shaft) used for a pole tamp.

Figure 4:
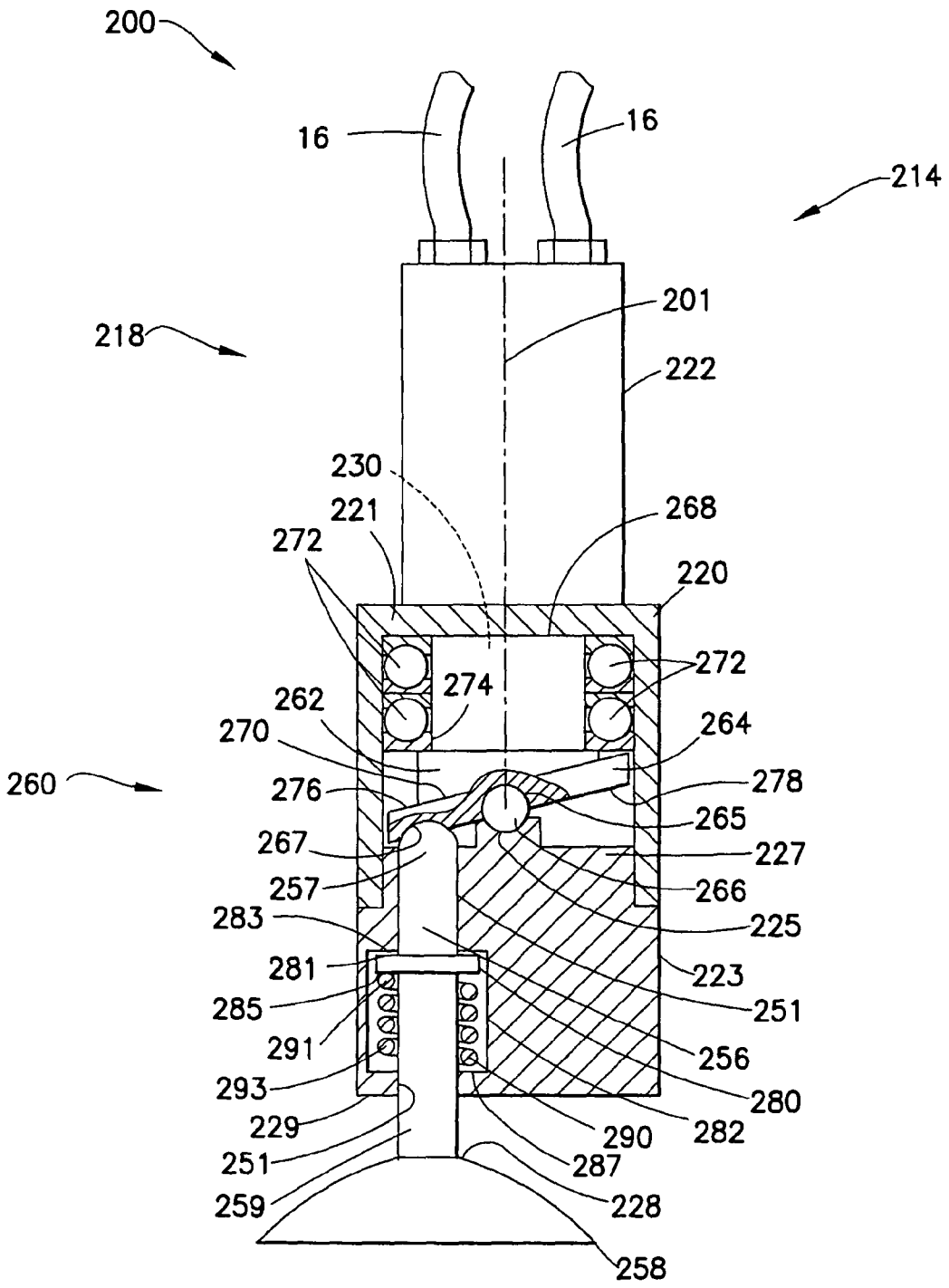
FIG. 4 is a section view of another tamper device incorporating features of the invention.

Referring now also to FIG. 4, a tamper device 200 in accordance with an alternate embodiment of the invention is shown. The tamper device 200 is similar to the tamper device 10, 100 and similar features are similarly numbered. The tamper device 200 comprises an upper frame section (not shown) and a lower frame section 214. It should be noted that the upper frame section is not shown in FIG. 4 for the purposes of clarity, however, one skilled in the art will appreciate that the upper frame section is not required and that alternate embodiments may comprise only a single frame section.

The lower frame section 214 comprises a drive assembly 218. According to this embodiment, the drive assembly 218 may comprise a wobble plate drive assembly. The wobble plate drive assembly 218 comprises a housing 220, a hydraulic motor 222, a wobble connection 260, and a tamper 228.

The housing 220 is suitably sized and shaped to house various of the assembly components therein. The housing 220 comprises an upper housing member 221 and a lower housing member 223. The housing members 221, 223 may each comprise a suitably sized and shaped members formed from metal. However, any suitable configuration or material may be provided for the housing 220 and housing members 221, 223.

The motor 222 comprises any suitable type of hydraulic motor. Additionally, the hydraulic lines 16 may be connected to the hydraulic motor 222 in any suitable fashion. The hydraulic motor (or drive) 222 comprises an output shaft 230. The output shaft 230 extends from an end of the motor 222. The motor 222 may be mounted to the upper housing member 221 such that the output shaft 230 extends through an opening in the upper housing member 221. In the embodiment shown in FIG. 4, an end portion of the motor 222 is connected to the upper housing member 221. In alternate embodiments, the upper housing member 221 (or any other suitable portion of the housing 220) may surround, and/or support, a portion or the entire motor 222. However, any suitable motor and/or housing configuration may be provided.

The wobble connection 260 is between the drive 222 and the tamper 228. The wobble connection 260 is configured to convert a rotational motion of the drive 222 into a reciprocal motion of the tamper 228. The wobble connection 260 comprises an angle plate 262, a wobble plate 264, and a pivot ball 266.

The angle plate 262 comprises a cylindrical member having a top end 268 and a bottom end 270. The top end 268 of the angle plate 262 is connected to the output shaft 230 of the drive 222. The angle plate 262 may be connected to the output shaft 230 in any suitable fashion such as a keying or locking engagement. However, any suitable configuration could be provided. The bottom end 270 of the angle plate 262 is angled relative to the top end 268 and contacts the wobble plate 264. In this embodiment the angle plate 262 comprises a one piece member formed from metal. However, any suitable configuration or material may be provided for the angle plate.

The angle plate 262 is mounted in the upper housing member 221 by radial bearings 272. The radial bearings 272 could comprise radial ball bearings for example. The radial bearings 272 are located against an outer perimeter 274 of the angle plate 262. It should be noted that in alternate embodiments, an axial bearing, or any other suitable type bearings may be provided instead of, or in combination with, the radial bearings.

The wobble plate 264 comprises a general disk shape and is located at the bottom end 270 of the angle plate 262. The wobble plate 264 comprises a top side 276 and a bottom side 278. The top side 276 contacts the bottom end 270 of the angle plate 262. The bottom side 278 is opposite the lower housing member 223 and comprises a center pivot pocket 265 and a ram pocket 267. The pivot pocket 265 may be disposed in a substantial center portion of the bottom side 278. The ram pocket 267 may disposed proximate an outer perimeter of the bottom side 278. In this embodiment the wobble plate 264 comprises a one piece member formed from metal. However, any suitable configuration or material may be provided for the wobble plate 264.

The pivot ball 266 is connected between the wobble plate 264 and the lower housing member 223. The pivot ball 266 comprises a general spherical shape. Additionally, in this embodiment the pivot ball 266 comprises a one piece member formed from metal. However, any suitable configuration or material may be provided for the pivot ball. The pivot ball 266 is located at a pocket 225 of the lower housing member 223 and the pocket 265 to pivotably connect the wobble plate 264 to the housing 220. In an alternate embodiment, any suitable pivotable connection could be provided, such as the pivot member being integrally formed with the housing or the wobble plate for example.

The lower housing member 223 is connected to the upper housing member 221 and forms a lower portion of the housing 220. The lower housing member 223 may be connected to the upper housing member 221 in any suitable fashion. The lower housing member 223 comprises an opening 251 extending from a top end 227 of the lower housing member 223 to a bottom end 229 of the lower housing member 223.

The tamper 228 comprises a ram portion 256 and a shoe portion 258. The ram portion 256 extends through the opening 251 and is movably connected to the lower housing member 223. One end 257 of the ram portion is received by the ram pocket 267 of the wobble plate 264. The other end 259 of the ram portion 256 extends from the bottom end 229 of the lower housing member 223. Additionally a flange portion 280 is provided between and spaced from the ends 257, 259. The flange portion 280 is suitably sized and shaped to be received by a chamber portion 282 of the opening 251. The flange section 280 provides a stop feature to limit upward travel of the tamper 228, wherein a top side 281 of the flange contacts an upper end 283 of the chamber portion 282 at the upper most position of the tamper 228. Additionally, a return spring 290 is provided between the tamper 228 and the lower housing member 223. The return spring 290 is disposed within the chamber portion 282 and surrounds the ram portion 256. One end 291 of the spring 290 contacts a bottom side 285 of the flange portion. The other end 293 of the spring 290 contacts a lower end 287 of the chamber portion 282. The spring 290 provides a biasing force on the tamper 228 in a direction towards the wobble plate 264.

The shoe portion 258 extends from the end 259 of the ram portion 256. The tamper 228 is adapted to reciprocate relative to the housing 220 and apply pressure to a surface. In this embodiment, the shoe portion 258 is suitably sized and shaped to apply pressure to a surface, such as soil for example. However, any suitable shoe portion configuration may be provided.

The top end 257 of the ram portion 256 is suitably sized and shaped to be located in the ram pocket 267. In the embodiment shown in FIG. 4 the return spring 290 keeps the top end 257 of the ram portion 256 located in (and in contact with) the ram pocket 267 (wherein the top end 257 of the ram portion 256 is substantially continuously located in the ram pocket 267 as the wobble plate 264 pivots). However, in some alternate embodiments, the spring may intermittently keep the top end of the ram portion located in the ram pocket (wherein, for example, the top end of the ram portion is spaced from, or partially located in, the ram pocket during portions of the wobble plate pivot motion). However, any suitable configuration may be provided. The curved shape of the ram pocket 267 and top end 257 of the ram portion 256 allow rotational sliding motion between the members 267, 257 as the wobble plate 264 moves and the tamper 228 reciprocates in and out of the opening 251.

The biasing force of the spring 290 and the engagement of the ram portion 256 in the pocket 267, in addition to its primary function, also may perform a secondary function of forming a system for preventing the wobble plate 264 from rotating about the axis of rotation 201. However, in alternate embodiments, additional or alternative means for preventing the wobble plate from rotating could be provided.

As the motor 222 runs, the output shaft 230 rotates the angle plate 262. With the bottom end 270 of the angle plate 262 angled relative to the axis of rotation 201, rotation of the angle plate 262 causes the wobble plate 264 to follow and pivot on the pivot member 266; effectively wobbling as the angle plate 262 rotates. This wobbling motion causes the tamper 228 to reciprocally move in and out of the opening 251. Thus, rotational motion provided by the output shaft 230 of the motor 222 can be converted into reciprocal motion of the tamper 228, and the tamper shoe portion 258 can move up and down to apply pressure to the surface.

Figure 5:
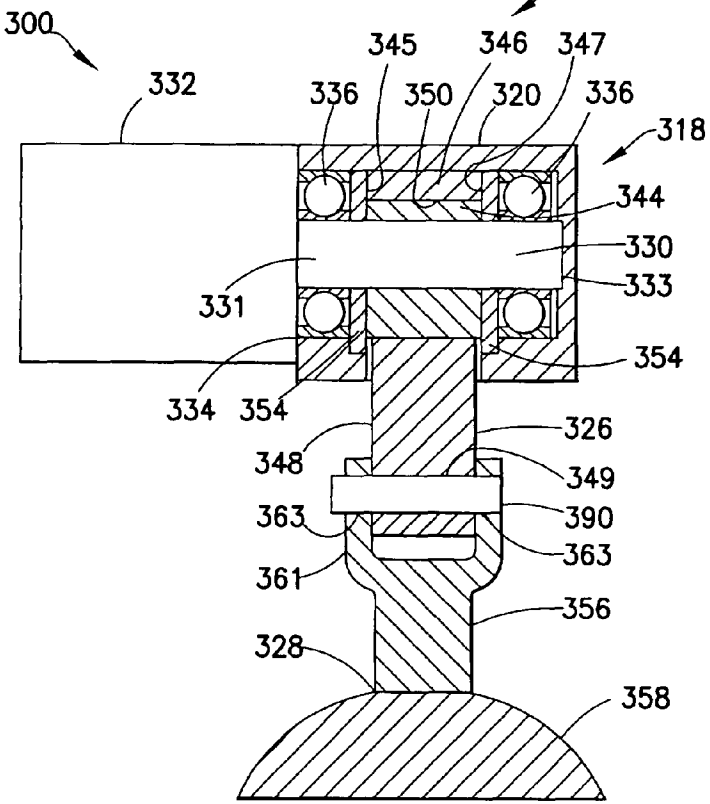
FIG. 5 is a section view of another tamper device incorporating features of the invention.

Referring now also to FIG. 5, a tamper device 300 in accordance with an alternate embodiment of the invention is shown. The tamper device 300 is similar to the tamper device 10, 100, 200 and similar features are similarly numbered. The tamper device 300 comprises an upper frame section (not shown) and a lower frame section 314. It should be noted that the upper frame section is not shown in FIG. 5 for the purposes of clarity, however, one skilled in the art will appreciate that the upper frame section is not required and that alternate embodiments may comprise only a single frame section.

The lower frame section 314 comprises a drive assembly 318. According to this embodiment, the drive assembly 318 may comprise a connecting rod drive assembly. The connecting rod drive assembly 318 comprises a housing 320, a hydraulic motor 322, a connecting rod 326, and a tamper 328.

The housing 320 is suitably sized and shaped to house various of the assembly components therein. The housing 320 may comprise any suitable configuration or material.

The motor 322 comprises any suitable type of hydraulic motor. Additionally, hydraulic lines (not shown) may be connected to the hydraulic motor 322 in any suitable fashion. The hydraulic motor (or drive) 322 comprises a rotatable output shaft 330. The output shaft 330 comprises a first end 331 and a second end 333. The first end 331 is connected to the motor 322, wherein the shaft 330 extends from an end of the motor 322. The second end 333 of the shaft 330 extends into the housing 320. The motor 322 may be mounted to the housing 320 such that the output shaft 330 extends through an opening 334 in the housing 320. In the embodiment shown in FIG. 5, an end portion of the motor 322 is connected to the housing 320. In alternate embodiments, the housing 320 (or any other suitable housing) may surround, and/or support, a portion, or the entire motor 322. However, any suitable motor and/or housing configuration may be provided.

The shaft 330 is movably mounted to the housing 320 with a pair of bearings 336 therebetween. The bearings 336 may be connected to the housing 320 in any suitable fashion. The bearings 336 provide support to the shaft 330 proximate the opposite ends 331, 333 of the shaft 330. The shaft 330 comprises a caming member 344, such as an eccentric cam, for example. The shaft 330 may be keyed to the eccentric cam 344 proximate a center portion of the shaft 330. However, the cam 344 may be connected to the shaft 330 in any suitable fashion. The eccentric cam 344 may comprise a general circular shape with a center of rotation of the cam 344 off center from a centerpoint of the general circular shape. However, any suitably shaped cam or caming member may be provided.

The connecting rod 326 comprises a first end portion 346 and an opposite second end portion 348. The first end portion 346 comprises an opening 350. The opening 350 surrounds the center portion of the shaft 330 and holds the caming member 344. As the shaft 330 and caming member 344 rotate, an outer surface of the caming member 344 contacts the opening 350 to convert the rotational motion of the shaft 330 to a reciprocal motion of the tamper 328. With the opening 350 extending through the first end portion 346, a pair of washers 354 may be provided between each side of the opening 350, between the bearings 336 and the caming member 344. For example, one of the washers 336 may be located at a first lateral side 345 of the first end portion 346, and the other one of the washers 336 may be located at a second lateral side 347 of the first end portion 346. The washers 354 may be any suitable type washers, such as Delrin® washers for example. The second end portion 348 of the connecting rod 326 is adapted to be connected to the tamper 328.

The tamper 328 comprises a ram portion 356 and a shoe portion 358. The ram portion 356 is connected to the connecting rod 326. The shoe portion 358 is opposite the ram portion 356. The shoe portion 358 is suitably sized and shaped to apply pressure to a surface, such as soil for example. In this embodiment, the ram portion 356 comprises a forked end 361 sized and shaped to receive the connecting rod 326. The tamper 328 may be secured to the connecting rod 326 by a wrist pin 390 extending through openings 363 at the forked end 361 and an opening 349 at the second end portion 348 of the connecting rod 326. The wrist pin 390 fastening configuration may allow for some pivoting (or movement between the connecting rod 326 and the tamper 328) when the connecting rod 326 moves in response to rotation of the caming member 344. However, it should be noted that any suitable configuration for connecting the tamper to the connecting rod may be provided.

As the hydraulic motor 322 runs, the output shaft 330 rotates and drives the eccentric cam 344 to rotate. The cam 344 held in the connecting rod opening 350 drives the ram portion 356 and the shoe portion 358 in the up and down motion used for a pole tamp.

Figure 6:
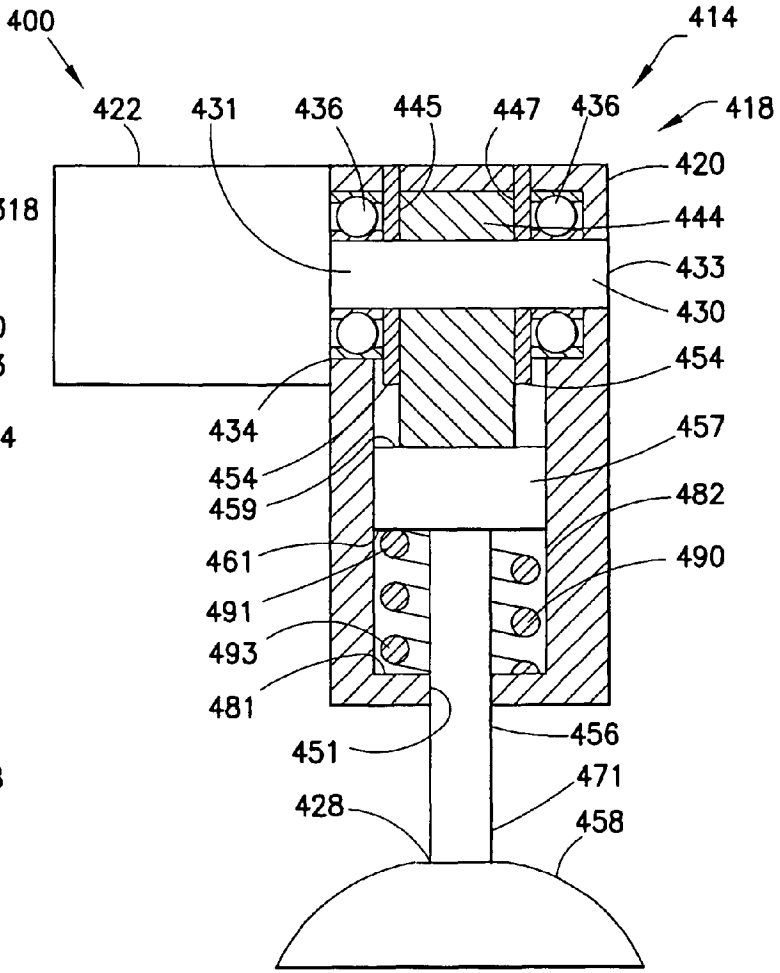
FIG. 6 is a section view of another tamper device incorporating features of the invention.

Referring now also to FIG. 6, a tamper device 400 in accordance with an alternate embodiment of the invention is shown. The tamper device 400 is similar to the tamper device 10, 100, 200, 300 and similar features are similarly numbered. The tamper device 400 comprises an upper frame section (not shown) and a lower frame section 414. It should be noted that the upper frame section is not shown in FIG. 6 for the purposes of clarity, however, one skilled in the art will appreciate that the upper frame section is not required and that alternate embodiments may comprise only a single frame section.

The lower frame section 414 comprises a drive assembly 418. According to this embodiment, the drive assembly 418 may comprise an eccentric cam drive assembly. The eccentric cam drive assembly 418 comprises a housing 420, a hydraulic motor 422, an eccentric cam 444, and a tamper 428.

The housing 420 is suitably sized and shaped to house various of the assembly components therein. The housing may 420 comprise any suitable configuration or material.

The motor 422 comprises any suitable type of hydraulic motor. Additionally, hydraulic lines (not shown) may be connected to the hydraulic motor 422 in any suitable fashion. The hydraulic motor (or drive) 422 comprises a rotatable output shaft 430. The output shaft 430 comprises a first end 431 and a second end 433. The first end 431 is connected to the motor 422, wherein the shaft 430 extends from an end of the motor 422. The second end 433 of the shaft 430 extends into the housing 420. The motor 422 may be mounted to the housing 420 such that the output shaft 430 extends through an opening 434 in the housing 420. In the embodiment shown in FIG. 6, an end portion of the motor 422 is connected to the housing 420. In alternate embodiments, the housing 420 (or any other suitable housing) may surround, and/or support, a portion or the entire motor 422. However, any suitable motor and/or housing configuration may be provided.

The shaft 430 is movably mounted to the housing 420 with a pair of bearings 436 therebetween. The bearings 436 may be connected to the housing 420 in any suitable fashion. The bearings 436 provide support to the shaft 430 proximate the opposite ends 431, 433 of the shaft 430. The shaft 430 comprises the caming member 444, which may be an eccentric cam, for example. The shaft 430 may be keyed to the eccentric cam 444 proximate a center portion of the shaft 430. However, the cam 444 may be connected to the shaft 430 in any suitable fashion. The eccentric cam 444 may comprise a general circular shape with a center of rotation of the cam 444 off center from a centerpoint of the general circular shape. However, any suitably shaped cam or caming member may be provided.

A pair of washers 454 may be provided between the bearings 436 and the caming member 444. For example, one of the washers 454 may be located at a first lateral side 445 of the cam 444, and the other one of the washers 454 may be located at a second lateral side 447 of the cam 444. The washers 454 may be any suitable type washers, such as Delrin® washers for example.

The tamper 428 comprises a ram portion 456 and a shoe portion 458. The ram portion 456 extends through an opening 451 in the housing 420 where an end 457 of the ram portion 456 is received by a ram receiving portion 482 in the housing 420. The end 457 of the ram portion 456 is movably connected to the housing 420. The end 457 of the ram portion 456 is suitably sized and shaped to be received by the ram receiving portion 482. A top side 459 of the end 457 of the ram portion 456 contacts the caming member 444. Additionally, a return spring 490 is provided between the ram portion 456 and the housing 420. The return spring 490 is disposed within the ram receiving portion 482 and surrounds the ram portion 456. One end 493 of the spring 490 contacts a bottom side 481 of the ram receiving portion 482. The other end 491 of the spring 490 contacts a bottom side 461 of the end 457 of the ram portion 456. The spring 490 provides a biasing force on the tamper 428 in a direction towards the caming member 444.

The shoe portion 458 is connected to the end 471 of the ram portion 456 which extends out of the housing 420 (through opening 451). The shoe portion 458 and the ram portion 456 may be formed as a one piece member. However, in alternate embodiments, the shoe portion and ram portion may be attached in any suitable fashion. The tamper 428 is adapted to reciprocate relative to the housing 420 and apply pressure to a surface. In this embodiment, the shoe portion 458 is suitably sized and shaped to apply pressure to a surface, such as soil for example. However, any suitable shoe portion configuration may be provided.

As the hydraulic motor 422 runs, the output shaft 430 rotates and drives the eccentric cam 444 to rotate. The cam 444 drives the end 457 of the ram portion 456 against the bias of the spring 490, and as the cam 444 continues its motion, the spring 490 pushes the ram 456 towards the cam 444. This produces the up and down motion used for a pole tamp to compact soil, for example.

Figure 7:
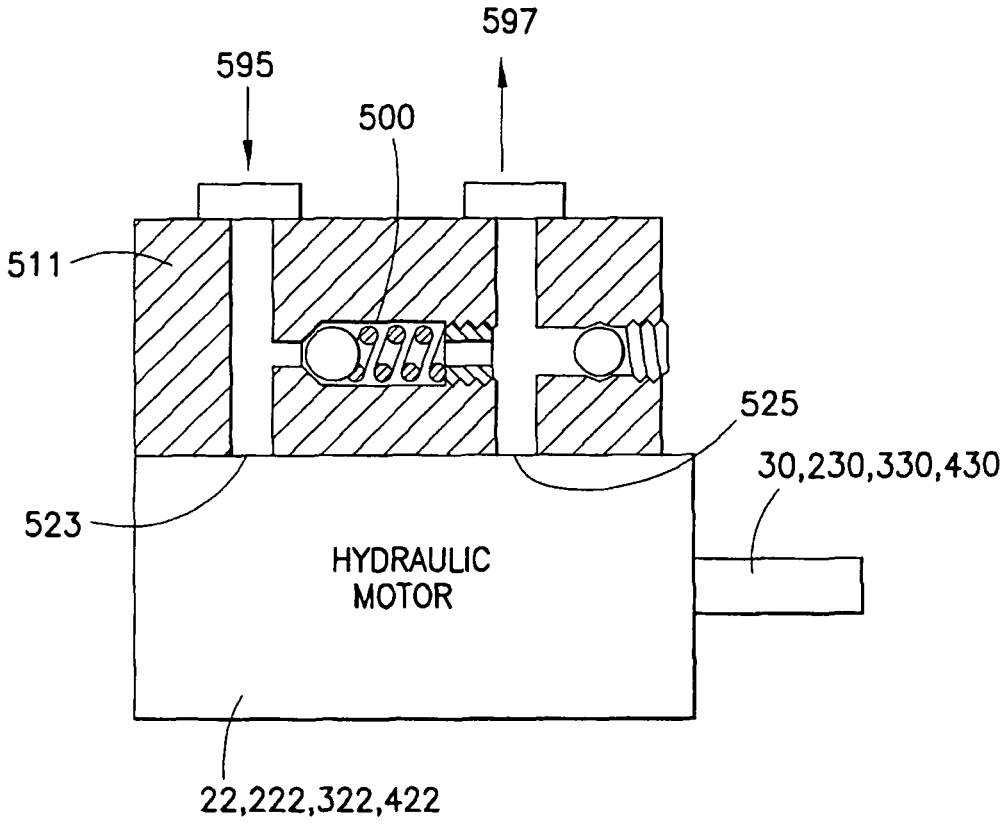
FIG. 7 is a section view of flow regulating valve used with the various embodiments.

Referring now also to FIG. 7, a flow regulating valve 500 is illustrated. The flow regulating valve 500 may be suitably disposed in a housing 511 configured to be connected to the hydraulic motor 22, 222, 322, 422. According to some embodiments of the invention, the flow regulating valve 500 may be connected to a fluid inlet 523 and a fluid outlet 525 of the hydraulic motor 22, 222, 322, 422 at one side of the valve 500, and a fluid inlet 595 and a fluid outlet 597 of a hydraulic system at another side of the valve 500. However, it should be noted that the flow regulating valve 500 is not required and the tamper device 10, 100, 200, 300, 400 may be configured to operate without the flow regulating valve 500.

When the device 10, 100, 200, 300, 400 is connected to a hydraulic system that provides more oil flow than required for normal operation of the device, a flow regulating valve 500 may be installed between the fluid inlet 523 and the fluid outlet 525 to the hydraulic pump. This generally provides a fluid path back to a hydraulic tank or reservoir, while still allowing normal operation of the device. For example, a device may be designed to operate at five gallons per minute hydraulic fluid flow. If the device is operated on a system that provides ten gallons per minute, the flow regulating valve could send the excess oil/fluid back to the tank/reservoir. It should be understood that five gallon per minute and ten gallon per minute flows described above are provided merely as non-limiting examples and any suitable amount of flow regulating may be provided by the flow regulating valve.

According to another example of the invention, a method of manufacturing a tamper device is disclosed. The method includes the following steps. Providing a housing. Connecting a drive to the housing. Movably connecting a tamper to the housing, wherein the tamper is adapted to apply pressure to a surface. Connecting a wobble connection between the drive and the tamper, wherein the wobble connection comprises a wobble plate, and wherein the wobble plate is adapted to apply a reciprocating force to the tamper. It should be noted that any of the above steps may be performed alone or in combination with one or more of the steps.

According to another example of the invention, a method of manufacturing a tamper device is disclosed. The method includes the following steps. Providing a drive having an output shaft. Connecting a housing to the drive, wherein at least a portion of the output shaft extends into the housing. Attaching a caming member to the output shaft. Providing a connecting rod, wherein a first end portion of the connecting rod extends into the housing, wherein the first end portion comprises an opening, and wherein a second end portion of the connecting rod extends out of the housing. Movably connecting the caming member to the first end portion, wherein the cam is at the opening, wherein the output shaft is spaced from the opening, and wherein the output shaft extends through the opening. Connecting a tamper to the second end portion of the connecting rod. It should be noted that any of the above steps may be performed alone or in combination with one or more of the steps.

Below are provided further descriptions of various non-limiting, exemplary embodiments. The below-described exemplary embodiments are separately numbered for clarity and identification. This numbering should not be construed as wholly separating the below descriptions since various aspects of one or more exemplary embodiments may be practiced in conjunction with one or more other aspects or exemplary embodiments. That is, the exemplary embodiments of the invention, such as those described immediately below, may be implemented, practiced or utilized in any combination (e.g., any combination that is suitable, practicable and/or feasible) and are not limited only to those combinations described herein and/or included in the appended claims.

(1) In one exemplary embodiment, a tamper device comprising: a housing; a drive connected the housing; a tamper adapted to reciprocate relative to the housing and apply pressure to a surface; and a wobble connection between the drive and the tamper, wherein the wobble connection comprises a wobble plate, and wherein a first end portion of the tamper is at a side of the wobble plate.

A tamper device as above, wherein the wobble connection further comprises an angle plate, wherein one end of the angle plate is connected to a shaft of the drive, and wherein another end of the angle plate contacts the wobble plate.

A tamper device as above, wherein the wobble connection further comprises a pivot ball connected to a center portion of the wobble plate.

A tamper device as above, further comprising a spring between the tamper and the housing.

A tamper device as above, wherein the wobble connection further comprises an angle plate, wherein one end of the angle plate is connected to a shaft of the drive, wherein another end of the angle plate contacts the wobble plate, and wherein the wobble connection further comprises a pivot ball connected to a center portion of the wobble plate.

A tamper device as above, further comprising a spring between the tamper and the housing.

A tamper device as above, wherein the tamper comprises a ram portion at one end of the tamper and a tamper shoe portion at another other end of the tamper.

A tamper device as above, wherein the drive comprises a hydraulic motor.

A tamper device as above, further comprising a flow regulating valve, wherein the flow regulating valve is connected between an inlet and an outlet of the hydraulic motor.

A tamper device as above, wherein the wobble connection is adapted to convert a rotational motion of the drive into a reciprocal motion of the tamper.

(2) In another exemplary embodiment, a tamper device comprising: a housing; a rotatable shaft having a first end and a second end, wherein the first end is adapted to be connected to a drive, and wherein the second end extends into the housing; a caming member connected to the rotatable shaft; a connecting rod having a first end portion and a second end portion, wherein the first end portion comprises an opening, wherein the caming member is located at the opening, and wherein the first end portion is between and spaced from the first end and the second end of the rotatable shaft; and a tamper connected to the second end portion of the connecting rod.

A tamper device as above, further comprising a first bearing between the housing and the rotatable shaft, wherein the first bearing is proximate the first end of the rotatable shaft.

A tamper device as above, further comprising a second bearing between the housing and the rotatable shaft, wherein the second bearing is proximate the second end of the rotatable shaft.

A tamper device as above, further comprising a first washer and a second washer on the shaft, wherein the first washer is adjacent a first lateral side of the connecting rod, and wherein the second washer is adjacent a second lateral side of the connecting rod.

A tamper device as above, further comprising a first bearing and a second bearing, wherein the first bearing is between the housing and the rotatable shaft, wherein the first bearing is proximate the first end of the rotatable shaft, wherein the second bearing is between the housing and the rotatable shaft, wherein the second bearing is proximate the second end of the rotatable shaft.

A tamper device as above, further comprising a first washer and a second washer on the shaft, wherein the first washer is adjacent a first lateral side of the connecting rod, and wherein the second washer is adjacent a second lateral side of the connecting rod.

A tamper device as above, further comprising a pin extending through the second end portion of the connecting rod and the tamper, wherein the pin movably connects the tamper to the connecting rod.

A tamper device as above, wherein the drive comprises a hydraulic motor.

A tamper device as above, further comprising a flow regulating valve, wherein the flow regulating valve is connected between an inlet and an outlet of the hydraulic motor.

A tamper device as above, wherein the tamper comprises a tamper shoe portion, wherein the tamper shoe portion is adapted to reciprocate and apply pressure to a surface.

(3) In another exemplary embodiment, a method of manufacturing a tamper device comprising: providing a housing; connecting a drive to the housing; movably connecting a tamper to the housing, wherein the tamper is adapted to apply pressure to a surface; and connecting a wobble connection between the drive and the tamper, wherein the wobble connection comprises a wobble plate, and wherein the wobble plate is adapted to apply a reciprocating force to the tamper.

A method as above, wherein the connecting of the wobble plate further comprises connecting an angle plate to a shaft of the drive, wherein the angle plate is in contact with the wobble plate.

A method as above, further comprising connecting a pivot ball between the wobble plate and the housing.

(4) In another exemplary embodiment, a method of manufacturing a tamper device comprising: providing a drive having an output shaft; connecting a housing to the drive, wherein at least a portion of the output shaft extends into the housing; attaching a caming member to the output shaft; providing a connecting rod, wherein a first end portion of the connecting rod extends into the housing, wherein the first end portion comprises an opening, and wherein a second end portion of the connecting rod extends out of the housing; movably connecting the caming member to the first end portion, wherein the cam is at the opening, wherein the output shaft is spaced from the opening, and wherein the output shaft extends through the opening; and connecting a tamper to the second end portion of the connecting rod.

A method as above, further comprising providing a first bearing between an end of the output shaft and the caming member.

A method as above, further comprising: providing a washer between the bearing and the first end portion of the connecting rod.

It should be understood that components of the invention can be operationally coupled or connected and that any number or combination of intervening elements can exist (including no intervening elements). The connections can be direct or indirect and additionally there can merely be a functional relationship between components.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. A tamper device comprising:
- a housing;
- a drive connected the housing;
- a tamper adapted to reciprocate relative to the housing and apply pressure to a surface; and
- a wobble connection between the drive and the tamper, wherein the wobble connection comprises a wobble plate, and wherein a first end portion of the tamper is at a side of the wobble plate.

2. A tamper device as in claim 1 wherein the wobble connection further comprises an angle plate, wherein one end of the angle plate is connected to a shaft of the drive, and wherein another end of the angle plate contacts the wobble plate.

3. A tamper device as in claim 1 wherein the wobble connection further comprises a pivot ball connected to a center portion of the wobble plate.

4. A tamper device as in claim 1 further comprising a spring between the tamper and the housing.

5. A tamper device as in claim 1 wherein the wobble connection further comprises an angle plate, wherein one end of the angle plate is connected to a shaft of the drive, wherein another end of the angle plate contacts the wobble plate, and wherein the wobble connection further comprises a pivot ball connected to a center portion of the wobble plate.

6. A tamper device as in claim 5 further comprising a spring between the tamper and the housing.

7. A tamper device as in claim 6 wherein the tamper comprises a ram portion at one end of the tamper and a tamper shoe portion at another other end of the tamper.

8. A tamper device as in claim 1 wherein the drive comprises a hydraulic motor.

9. A tamper device as in claim 8 further comprising a flow regulating valve, wherein the flow regulating valve is connected between an inlet and an outlet of the hydraulic motor.

10. A tamper device as in claim 1 wherein the wobble connection is adapted to convert a rotational motion of the drive into a reciprocal motion of the tamper.

11. A method of manufacturing a tamper device comprising:
- providing a housing;
- connecting a drive to the housing;
- movably connecting a tamper to the housing, wherein the tamper is adapted to apply pressure to a surface; and
- connecting a wobble connection between the drive and the tamper, wherein the wobble connection comprises a wobble plate, and wherein the wobble plate is adapted to apply a reciprocating force to the tamper.

12. A method as in claim 11 wherein the connecting of the wobble plate further comprises connecting an angle plate to a shaft of the drive, wherein the angle plate is in contact with the wobble plate.

13. A method as in claim 11 further comprising connecting a pivot ball between the wobble plate and the housing.

* * * * *